United States Patent [19]

Ahmed et al.

[11] 4,242,897

[45] Jan. 6, 1981

[54] EXTRUSION MACHINE AND METHOD OF CONTINUOUS TUBULAR EXTRUSION

[76] Inventors: Nazeer Ahmed; Myrna M. Ahmed, both of 8 Tee Ar Pl., Princeton, N.J. 08540

[21] Appl. No.: 19,717

[22] Filed: Mar. 12, 1979

[51] Int. Cl.[3] ..... B21C 25/04; B21C 29/00; B21C 33/02

[52] U.S. Cl. ..... 72/262; 72/261; 72/269; 72/270

[58] Field of Search ..... 72/253 R, 261, 262, 72/253 A, 269, 270

[56] References Cited

U.S. PATENT DOCUMENTS

| | | | |
|---|---|---|---|
| 2,760,229 | 8/1956 | Cheney et al. | 425/113 |
| 3,765,216 | 10/1973 | Green | 72/262 |
| 3,824,825 | 7/1974 | Green | 72/262 |
| 3,911,705 | 10/1975 | Voorhes | 72/270 |
| 3,934,446 | 1/1976 | Avitzur | 72/262 |
| 4,041,595 | 8/1977 | Voorhes | 72/262 |
| 4,094,178 | 6/1978 | Fuchs | 72/270 |
| 4,163,377 | 8/1979 | Moreau | 72/258 |
| 4,177,658 | 12/1979 | Ahmed et al. | 72/262 |

FOREIGN PATENT DOCUMENTS

| | | | |
|---|---|---|---|
| 2708458 | 8/1978 | Fed. Rep. of Germany | 72/262 |
| 484030 | 12/1975 | U.S.S.R. | 72/269 |

*Primary Examiner*—Lowell A. Larson

[57] ABSTRACT

The invention describes a machine and a process whereby a material of unlimited length is continuously extruded into a tubular shape. Two annular toruses have their inner rims connected to rotating drive shafts by leaf springs. The exterior toroidal surfaces have suitable shaped grooves on them. The toruses are squeezed against each other radially by suitable means so as to cause a maximum radial deformation in each of them of a magnitude substantially greater than 0.2 percent but less than an amount that would cause permanent set in the torus material or the leaf springs. This deformation forms a contact length between the two toruses. A further requirement of the radial deformation on the two toruses is that the contact length between them be at least twice the extrusion length necessary for the contemplated extrusion. A bridge die supported by a die stem is located substantially at the center of the contact length. A heated material of unlimited length is fed between the toruses into the chamber formed by the grooves. The toruses are rotated by rotating the drive shafts. The incoming material is pushed by the friction between the toruses and the material. The extrusion length is the minimum contact length between the toruses and the extruding rod which enables the friction drive stresses to generate a pressure at the die sufficient for the contemplated extrusion. Since the contact length between the toruses is greater than twice the necessary extrusion length, the incoming material extrudes through the bridge die. In the die the material splits into a plurality of streams and is then recombined to form a tubular product of unlimited length.

11 Claims, 9 Drawing Figures

EXTRUSION MACHINE AND METHOD OF CONTINUOUS TUBULAR EXTRUSION

FIELD OF INVENTION

This invention relates to the extrusion of tubular products of unlimited length. More particularly, it relates to an extrusion machine the basic elements of which are two annular toruses the external toroidal surfaces of which have suitable shaped grooves. The inner rim of each torus is connected to a rotating drum by leaf springs. The two annular toruses are squeezed against each other to create a contact length. A bridge die that separates the incoming material into two or more streams and recombines the streams into a tubular product is located substantially near the center of the contact length. The material to be extruded is heated and is fed towards the die by rotating together the toruses. A tubular product of unlimited length is thus extruded.

DESCRIPTION OF PRIOR ART

A metod of continuously extruding materials was described in U.S. patent application Ser. No. (Series of 1970): 914,789, Filing date 06/12/78, Group No. 321 by N. Ahmed and Myrna Mintz Ahmed. In that method a continuously moving high pressure chamber is built up of two solid toruses which are pressed radially against each other so as to cause a deformation in each in excess of 0.2 percent. This squeezing creates a three dimensional stress distribution along the length of contact which stress is substantially hydrostatic. The material to be extruded is gripped between the two toruses and is fed into a die located near the center of the contact length. The need to deform the two toruses in excess of 0.2 percent requires such toruses to be built up of highly deformable materials such as plastics or a plastic core surrounded by a veneer of coated metal. The presence of plastics which have a low melting point as compared to metals may make it difficult to extrude metals at elevated temperatures.

The objectives of this invention are:

(a) To provide an extrusion machine where the need for highly deformable materials such as plastics is dispensed with so that the entire toroidal construction is of metal components;

(b) To provide an extrusion machine in which drive tractions are applied over the entire surface of the material to be extruded;

(c) To provide an extrusion machine using which a tubular product of unlimited length is extruded;

(d) To provide a method and process of continuous extrusion of a tubular product of unlimited length in which drive tractions are applied over the entire surface of an incoming heated material which material is split in a bridge die into two or more streams and then recombined to form a continuous tubular product;

(e) To provide an extrusion machine which is simple to build, operate and maintain.

SUMMARY OF THE INVENTION

The invention contemplates a machine and a process whereby a material of unlimited length is continuously extruded into a tubular shape. Two annular toruses have their inner rims connected to rotating drums by leaf springs. The exterior toroidal surfaces have suitable shaped grooves on them. The toruses are squeezed against each other radially by suitable means so as to cause a maximum radial deformation in each of them of a magnitude substantially greater than 0.2 percent but less than an amount that would cause permanent set in the torus material. This deformation forms a contact length between the two toruses. A bridge die supported by a suitable die stem is located substantially at the center of the contact length. A heated material of unlimited length is fed between the toruses into the chamber formed by the grooves. The toruses are rotated. The incoming material is pushed by the friction between the toruses and the material. Due to this push the incoming material is extruded through the bridge die. In the die the material splits into two or more streams and is then recombined to form a tubular product.

THE DRAWINGS

FIGS. 1*a* and 1*b* show two hollow toruses squeezed radially against each other to form a contact length L. The inner rim of each torus is connected to a drive drum by leaf springs.

Figure 7A:
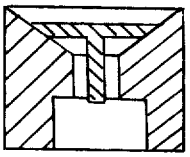
Figure 7B:
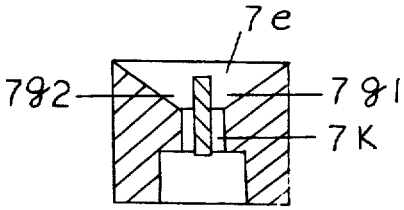

FIGS. 7*a* and 7*b* show two orthogonal views of a bridge die which forms a product of tubular cross section.

DETAILED DESCRIPTIONS

Figure 1A:
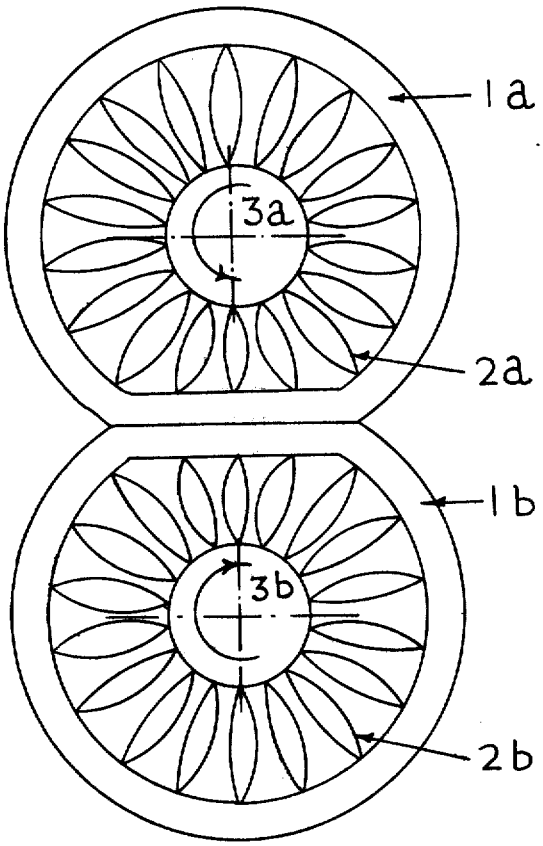
Figure 1B:
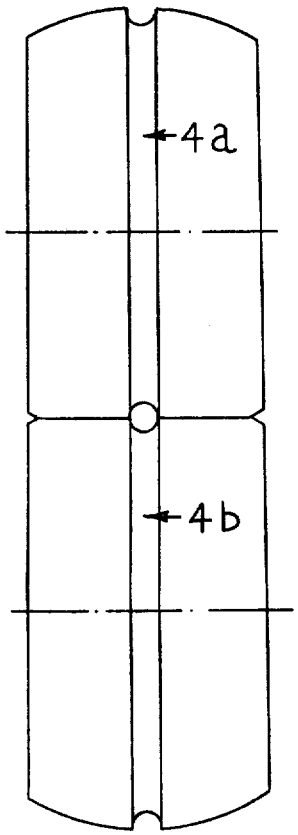

Consider FIG. 1. It shows two annular toruses 1*a* and 1*b* the exterior spherical surfaces of which have suitable shaped grooves 4*a* and 4*b* on them. The inner rims of the toruses are connected to drive shafts by leaf springs 2*a* and 2*b*. The toruses are pressed against each other to create a contact length L. FIG. 1*b* shows that the circumferential grooves on the two annular toruses cooperate to form a high pressure chamber. The deformation of each annular torus is of a magnitude substantially greater than 0.2 percent but less than would cause permanent set in the toruses or the leaf springs. Furthermore, the radial deformations are of such magnitude that the contact length L is at least twice the extrusion length $L_e$. The significance of the extrusion length will be explained later on in this specification.

Figure 2:
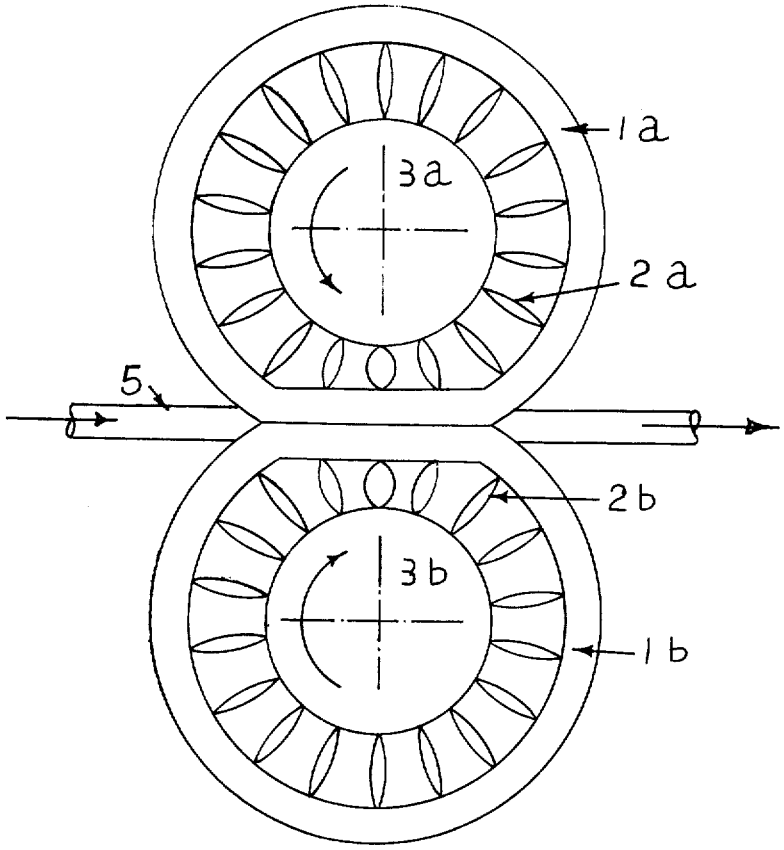
FIG. 2 shows a material being pushed by rotating the two toruses.

Extrusion refers to a process in which a material is pushed under compressive stresses through a deformation control element such as a die to form an alongated product. Continuous extrusion refers to an extrusion process where such deformation is carried out on a product of unlimited length. Consider FIG. 2. In this figure a continuous rod 5 is being pushed by the friction between it and the rotating toruses.

The shear stress between the moving toruses and the incoming rod which is responsible for pushing the rod forward is given by Coulomb friction $$\tau = \sigma\mu \tag{1}$$

where $\mu$ is the coefficient of friction between the toruses and the rod and $\sigma$ is the radial pressure. Due to this shear stress an axial compressive stress is generated in the incoming rod. If A is the area of cross section of the incoming rod, s the length of its perimeter, the incremental axial stress $\Delta\sigma$ along an incremental length $\Delta\chi$ is given by force balance $$\Delta\sigma = \lambda\tau\Delta\chi/A \quad (2)$$

It is seen that the distribution of axial stress in the incoming rod is similar to that of the shear stress along its periphery. The total force tending to push the rod along a length $L_e$ is determined by integrating $\Delta\sigma$ along this length:

$$\sigma_c = \frac{\zeta\tau\Delta x}{A} \quad (3)$$

It is this force $\sigma$ that provides the necessary push for the incoming rod in its axial direction. If p is the pressure needed for the extrusion of a material of yield strength Y through a specified extrusion ratio, then from Tresca Yield criterion (Ref: An Introduction to Principles of Metal Working by G. W. Rowe, St. Martin Press, 1965, p 113):

$$\rho - \sigma = \gamma \quad (4)$$

Since the quantities Y, p, A, $\mu$ are known the required length of contact between the extruding rod and the toruses to generate the extrusion pressure p can be calculated.

EXAMPLE

Consider an extrusion machine to be built as per this disclosure for an extrusion pressure of 50,000 psi. Suppose the material to be extruded is 0.375 inch diameter Aluminum of grade 1100 in the annealed condition whose yield strength is 5,000 psi. (Ref: Materials Engineering, A Penton/IPC Reinhold Publication, 1977, p 63). Then, from Tresca Yield criterion, Eq. (4), $$50{,}000 - \sigma = 5{,}000 \quad (5)$$

From this the minimum compressive stress needed for extrusion is 45,000 psi.

The annular toruses may be built of steel. The coefficient of friction between steel and aluminum is approximately 0.1 (Ref: Friction Studies of Tool Steel against aluminum under high pressure using liquid lubricants, by P. S. Venkatesan, N. Ahmed et. al., *Wear*, Vol. 17, (1971), pages 245-258).

As a first step in the calculation of the extrusion length $L_e$, the incremental length $\Delta x$ needed to generate a compressive stress $\Delta\sigma = 10{,}000$ psi in the aluminum rod is calculated.

For a 0.375 inch diameter rod, cross sectional area $A = 0.109$ square inches

Circumference $s = 1.18$ inches

From Eq. (1), $\tau = \mu\sigma = 0.1 \times 45{,}000 \times 4{,}500$ psi.

In this calculation an average value for the normal stress of 45,000 psi is used because as the axial compressive stress decreases from 45,000 psi to 35,000 psi the corresponding normal stress decreases from 50,000 psi to 40,000 psi.

From Eq.(2):

$$10{,}000 = \frac{1.18 \times 4{,}500 \times \Delta x_1}{0.109},$$

from which $\Delta\chi_1 = 0.205$ inches.

Similarly, as the compressive stress in the aluminum rod decreases from 35,000 psi to 25,000 psi, the corresponding normal stress decreases from 40,000 psi to 30,000 psi. Let $\Delta\chi_2$ be the distance in which this decrease occurs. On this length $\Delta\chi_2$ on an average basis, $$\tau = 0.1 \times 35{,}000 = 3{,}500 \text{ psi.}$$

From Eq.(2): $10{,}000 = 1.18 \times 3{,}500 \times \Delta\chi_2/0.109$, which gives $\Delta\chi_2 = 0.263$ inches.

In a similar manner, for the compressive stress in the rod to decrease from 25,000 psi to 15,000 psi, $$\Delta x_3 = 0.369 \text{ inches.}$$

For the compressive stress to decrease from 15,000 psi to 5,000 psi, $$\Delta x_4 = 0.615 \text{ inches.}$$

For the compressive stress to decrease from 5,000 psi to 0 psi, $$\Delta x_5 = 0.925 \text{ inches.}$$

The extrusion length is the minimum length of contact between the toruses and the incoming rod that is needed for extrusion. In this case the extrusion length $L_e$ is $$L_e = \Delta x_1 + \Delta x_2 + \Delta x_3 + \Delta x_4 + \Delta x_5 = 2.377 \text{ inches.}$$

Obviously, the above calculations may be repeated to calculate the extrusion length $L_e$ to a higher degree of accuracy by taking incremental pressure drops of less than 10,000 psi.

It has been mentioned earlier that the contact length L between the two annular toruses in an extrusion machine fabricated according to this disclosure should be at least twice the extrusion length $L_e$. In the present example it should be at least 4.75 inches.

Figure 5:
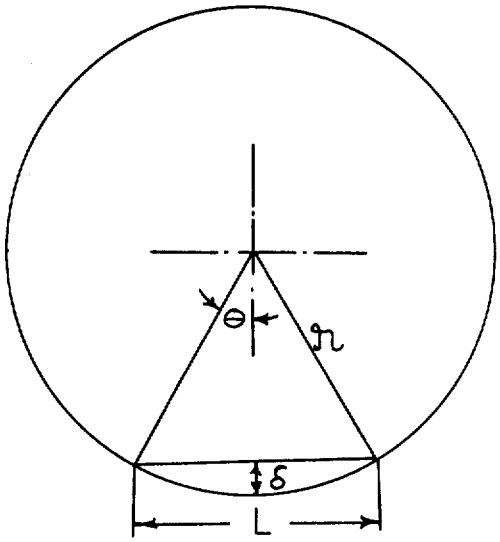
FIG. 5 shows a circle of radius r and a chord L which subtends an angle of 2 $\theta$ at the center of the circle.

In FIG. 5 is shown a circle of radius r where a chord of length L subtends an angle $2\theta$ at the center. From geometry $$L = 2r \sin\theta$$

Also, the radial distance $$\delta = r - r\cos\theta.$$

One may select toruses with a diameter of 4 feet each. With $r = 2$ feet, each torus needs to be deformed radially so that the radial displacement $\delta$ shown in FIG. 5 is 0.12 inch. This displacement is 0.25 percent of the diameter of the toruses. In a preferred embodiment of this disclosure the displacement $\delta$ should be two to three times the minimum value required. This creates a longer contact length than the minimum required and ensures a continuous feed even when there are surface imperfections on the incoming rod.

To summarise: For a continuous extrusion machine for an extrusion pressure of 50,000 psi, two toruses of diameter 48 inch each are used. The material for these toruses may be steel. The drive shafts 3*a* and 3*b* shown in FIG. 1 may be 3 feet diameter each. The inner rim of each torus may be of diameter 47.25 inch. The drive shafts are connected to the hollow toruses by leaf springs. The toruses are radially squeezed against each other until the radial deformation in each exceeds 0.12 inches causing a contact length of at least 4.75 inches. The width of the toruses may be chosen to be 3 inches.

Figure 4:
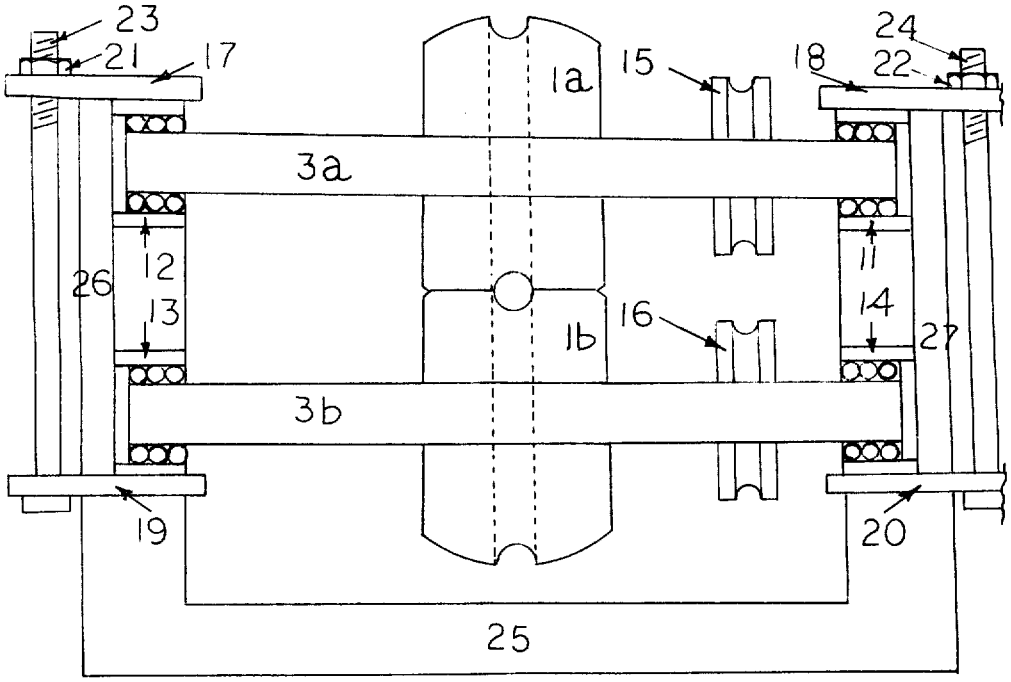
FIG. 4 shows an extrusion machine as envisaged in this invention.

FIG. 4 shows a continuous hydrostatic extrusion machine as embodied in this invention. The toruses 1*a* and 1*b* are mounted on shafts 3*a* and 3*b*. Shaft 3*a* is supported in roller thrust bearings 11 and 12. Shaft 3*b* is supported in roller thrust bearings 13 and 14. The shafts are driven by belt driven pulleys 15 and 16. In order to apply radial squeeze on the toruses, suitable squeeze plates are provided. In FIG. 5 squeeze plate 17 acts on bearing 12, squeeze plate 18 on bearing 11, squeeze plate 19 on bearing 13, and squeeze plate 20 on bearing 14. The bearings and hence the toruses mounted on shafts are squeezed together by tightening the nuts 21 and 22 on squeeze bolts 23 and 24. In order to prevent lateral wobbling as the toroids rotate together the bearings are mounted in a frame 25 which has vertical arms 26 and 27 with machined guide slots for the bearings.

Figure 3:
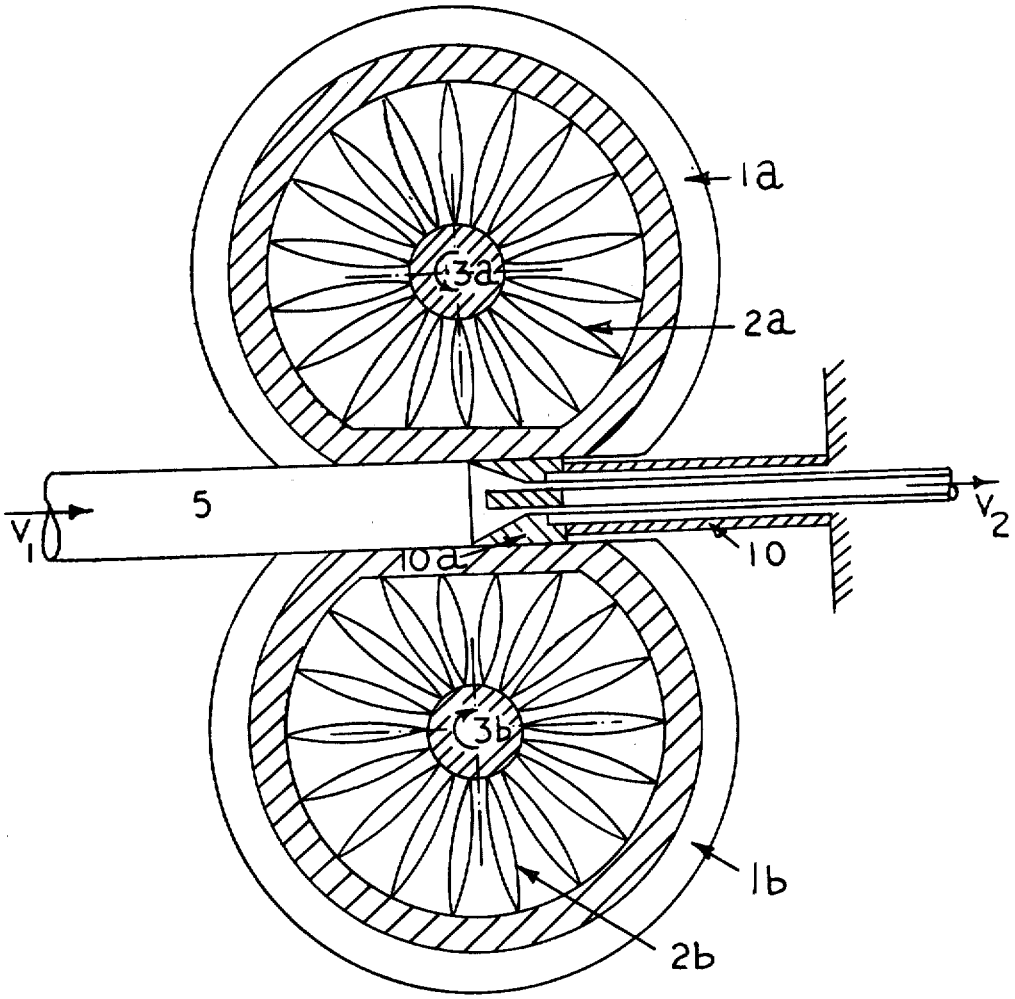
FIG. 3 shows the material being pushed into a die which is supported by a die stem.
Figure 6:
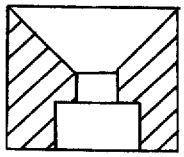
FIG. 6 shows the cross section of a die which forms a product of solid cross section.

As shown in FIG. 3 a bridge die 10*a* is located near the center of contact length. The die is supported by a die stem 10. To show the configuration of a bridge die, FIGS. 6 and 7 are drawn. FIG. 6 shows an extrusion die without a bridge. Such a die forms a product of solid cross section. FIGS. 7*a* and 7*b* show an extrusion die with a bridge. In a bridge die, the material entering the die mouth at 7*e* splits into a plurality of streams as shown at 7*g*1 and 7*g*2, then towards the exit end of the die at 7*k* recombines to form a single stream.

As the toruses 1*a* and 1*b* are rotated by rotating the pulleys 15 and 16 by the action of drive belts, an elongated material of unlimited length is fed into the contact area between the two hollow toruses. The fed material is preferably at an elevated temperature. For instance, for grade 1100 aluminum the preferred temperature is about 850 degrees Fahrenheit. Due to the friction between the toruses and the material, the material is pushed into the bridge die where it splits into a plurality of streams and recombines to form a continuous tubular product. An elongated tubular product of unlimited length exist from the die and may be taken up on a spool.

The description provided here is for a preferred embodiment of this invention. Variations are possible on this design which would not alter the basic nature of this continuous extrusion machine or the method of using it to produce an elongated product of tubular cross section. For instance, instead of feeding a heated material into the grooves between the two toruses, molten material may be directly poured into them which material would cool as it proceeded towards the bridge die and in the bridge die is formed into a continuous tubular product. It may also be that for some materials that are to be extruded it is not necessary to heat the feed material at all. An example of such material is lead. In yet other applications the incoming material may be cooled before it is fed into the continuous extrusion machine. The extrusion machine may be used to form an elongated product of solid cross section of unlimited length by substituting a die as in FIG. 6 for the bridge die as in FIG. 7.

What is claimed is:

1. A method wherein a tubular product of unlimited length is formed from a material of unlimited length by:

(a) feeding a material of unlimited length into a chamber formed by radially squeezing together two hollow toruses which have suitably shaped grooves on their toroidal surfaces and whose inner rims are connected to drive shafts by leaf springs and where the squeezing action between the two toruses is of sufficient magnitude to cause a radial deformation in each torus in excess of 0.2 percent but less than an amount which would cause permanent set in either the toruses or the leaf springs and which amount is such that the contact length between the two toruses is at least twice the extrusion length needed for the desired extrusion;

(b) locating a bridge die substantially near the center of contact length;

(c) supporting the said die on a die stem;

(d) rotating the two toruses together by suitable means so as to cause the incoming material of unlimited length to be pushed towards and into the bridge die;

(e) taking up the extruded tubular product of unlimited length on a suitable take up mechanism.

2. A method as in claim 1 where a die without a bridge is used in place of the bridge die and the extruded product is of solid cross section.

3. A method as in claim 1 where the incoming material is heated.

4. A method as in claim 1 where the incoming material is precooled.

5. A method as in claim 1 where a stream of molten material is directly cast into the grooves between the two toruses.

6. A process of forming an elongated tubular product of unlimited length which process consists of:

(a) Squeezing radially against each other two annular toruses which have grooves of suitable shape and size on their periphery and whose inner rims are connected to drive shafts by leaf springs such squeezing to be of magnitude sufficient to cause a radial deformation in each annular torus substantially in excess of 0.2 percent but less than an amount which would cause permanent deformation in either the toruses or the leaf springs and which deformation is of such magnitude that it causes a contact length between the two toruses at least equal to twice the extrusion length needed for the desired extrusion;

(b) Locating a suitable bridge die substantially near the center of the contact length;

(c) Rotating the two toruses together by suitable means so that the contact surfaces of the two toruses move together at substantially identical linear velocity;

(d) Feeding a material of unlimited length into the chamber formed by the grooves on the periphery of the toruses which have been squeezed against each other;

(e) rotating the two toruses so as to cause the incoming material to be pushed into the bridge die with substantially no slippage between the incoming material and the rotating toruses and causing the incoming material to split into a plurality of streams in the bridge die and then recombine into a tubular product of unlimited length.

7. A process as in claim 6 where a die without a bridge is used in place of the bridge die and the extruded product is of solid cross section.

8. A process as in claim 6 where the incoming material is heated.

9. A process as in claim 6 where the incoming material is precooled.

10. A process as in claim 6 where a stream of molten material is directly cast into the grooves between the two toruses.

11. An apparatus for the extrusion of an elongated material of unlimited length into an elongated tubular product of unlimited length consisting of:

(a) A first annular torus on the periphery of which is a suitably shaped groove and whose inner rim is connected to a first drive shaft by leaf springs;

(b) A second annular torus on the periphery of which is a suitably shaped groove and whose inner rim is connected to a second drive shaft by leaf springs;

(c) Bearings for locating the ends of said first and second drive shafts so that the axes of rotation of the two shafts are parallel to each other;

(d) Squeeze plate means for radially squeezing the two annular toruses so that the peripheral grooves on them cooperate to form a high pressure chamber and so that the radial deformation in each annular torus is in excess of 0.2 percent but less than an amount that causes a permanent set in either the toruses or the springs;

(e) A bridge die supported on a die stem located substantially near the center of the contact length between the annular toruses;

(f) Means for rotating the two drive shafts so that an elongated material of unlimited length fed into the high pressure chamber formed between the annular toruses is pushed by the toruses towards the split die with substantially no slippage between the incoming material and the toruses and substantially no upset in the incoming material before it enters the bridge die wherein the incoming material splits into a plurality of streams and then recombines to form an elongated tubular product of unlimited length.

* * * * *